United States Patent [19]

Garza-Ondarza

[11] Patent Number: 4,886,097

[45] Date of Patent: Dec. 12, 1989

[54] APPARATUS FOR HANDLING AND STORAGE OF PARTICULATE SOLIDS

[75] Inventor: Jose J. Garza-Ondarza, San Nicolas de Los Garza, Mexico

[73] Assignee: Hylsu S.A. de C.V., Mexico

[21] Appl. No.: 270,382

[22] Filed: Nov. 10, 1988

Related U.S. Application Data

[63] Continuation of Ser. No. 96,617, Sep. 14, 1987, abandoned.

[51] Int. Cl.[4] ..... B67C 11/00; B65B 39/00

[52] U.S. Cl. ..... 141/333; 141/339; 193/12; 222/460

[58] Field of Search ..... 141/98, 331–345; 193/12, 13; 222/564, 460–462

[56] References Cited

U.S. PATENT DOCUMENTS

| | | | |
|---|---|---|---|
| 426,667 | 4/1890 | Grissim | 141/331 |
| 1,479,660 | 1/1924 | Fuller | 141/338 |
| 1,928,459 | 9/1933 | Pardee | 193/12 |
| 2,106,527 | 1/1938 | Hostetter | 220/460 X |
| 3,125,256 | 3/1964 | Kokeisl | 222/195 |
| 3,485,420 | 12/1969 | Lucas | 222/564 |
| 3,593,892 | 7/1971 | Petit | 222/200 |
| 3,797,707 | 3/1974 | Jenike | 406/137 |
| 3,921,351 | 11/1975 | Johnson | 52/197 |
| 3,940,037 | 2/1976 | Watson | 222/564 |
| 4,531,876 | 7/1985 | Gessler | 414/325 |
| 4,611,730 | 9/1986 | Ikesue et al. | 222/564 |

FOREIGN PATENT DOCUMENTS

| | | | |
|---|---|---|---|
| 373872 | 5/1907 | France | 141/331 |
| 458386 | 10/1913 | France | 222/564 |

OTHER PUBLICATIONS

U. Tuzun and R. M. Nedderman, "Gravity Flow of Granular Materials Round Obstacles" (article published in Silos, Hoppers Bins . . . 1981–1985).

*Primary Examiner*—Ernest G. Cusick

*Attorney, Agent, or Firm*—A. Thomas S. Safford

[57] ABSTRACT

A container to handle particulate solids comprising a downwardly converging wall extending from an inlet to an outlet, the wall being provided with an internal inverted step extending along a portion of the converging wall. In order to minimize the solids compaction and flow stoppages, the internal inverted step extends helically along at least a portion of the converging wall to provide a continuous increase in the cross-sectional area of the container to promote solids flow.

17 Claims, 2 Drawing Sheets

APPARATUS FOR HANDLING AND STORAGE OF PARTICULATE SOLIDS

This application is a continuation of application Ser. No. 096,617, filed Sept. 14, 1987, now abandoned.

FIELD OF THE INVENTION

The invention relates to gravity discharge storage facilities, and more particularly to an improved configuration of bins, hoppers, silos and more generally, holding vessels used in the storage, retaining, handling and transport of particulate bulk solids, particularly cohesive particles such as, hot sponge iron and the like.

BACKGROUND OF THE INVENTION

The problem of achieving a satisfactory flow of particles out of bins, hoppers, silos and all kinds of holding or retaining vessels has been the subject of studies for over a hundred years. Often, when the volume of particles to be handled is large, gravity is relied upon to cause particles to flow out of storage. Although time and money have been spent with varying degrees of success to develop containing vessels for such materials, the problem of whether or not a given solid will flow out of a given container, once it is actually built, still persists.

Whenever a container is designed to have either a mass flow or a funnel flow, numerous factors have to be considered, particularly when test results or experience show that the material to be handled tends to adhere, cake, arch, interlock or solidify over time. The designer of an efficient storage container must be aware of the problems that can arise both during the storage and during the flow of the solids to be handled. Consequently, the flow properties of the solid to be handled have to be measured to design a suitable container. It is known that the behavior of particulate solids having different flow characteristics is very difficult to predict and many problems arise when such particles are handled within a confining vessel. When such flow properties change, due to e.g. changes in temperature, moisture content, etc. provisions have to be made to compensate for such changes in the container structure. Consequently such variations in the flow properties may make the solids flow both complex and critical. An improperly made container will tend to develop a number of unfavorable bulk solids characteristics which impede the flow of particles.

The principal known causes of flow interruptions or stoppages are packing, bridging and rat-holing phenomena. The origins of such phenomena are not well known or defined. Packing is an inevitable result of a large amount of particles pressing down toward the outlet or outlets of the handling vessel. Bridging or arching occurs when the particles are interlocked and packed by the pressure head from above, forming an arch strong enough to support the entire load of the material in the vessel. Rat-holing occurs when a small cylindrical volume of the material flows down to the outlet, leaving the main body of the material hung up on the wall of the handling vessel.

There are several general approaches employed by those skilled in the art when studying the flowability of particulate solids. These involve the determination of certain parameters of flowability by subjecting a sample of the particles to a shearing action, but prediction of the particle behavior is not always accurate or complete.

Numerous solutions have been proposed and are known from the technical literature. These solutions fall mainly into two classes. First, there are those that relate to the structure of the container itself and that aim to promote a mass flow, a funnel flow or a combined flow by modifying the physical characteristics of the container e.g. the type of wall, its shape, the material of which it is made, the use of internal supports and the nature of its inlets and outlets. The second class of proposed solutions relate to auxiliary devices or methods for promoting material flow. These may be internal or external and may be e.g. mechanical vibrators attached to the container wall, internal slippery liners, agitators, injection of gases to fluidize or otherwise facilitate particle flow, as well as chemicals to aid in solving specific problems.

It has been proposed in the past in order to solve the flow problems in bins and other like vessels to make such containers with very steep wall angles, as well as to avoid any flow obstruction or irregularity in the walls so that the smooth surface prevents stoppages and in some cases to use also some kind of flow aid or promoter.

OBJECTS OF THE INVENTION

Accordingly, it is an object of the invention to provide a container that favors and promotes the flow of particulate solids and minimizes stoppage therein.

It is another object of the invention to provide a container for handling particulate solids that is especially useful in handling cohesive particles e.g. hot sponge iron pellets.

It is another object of the invention to provide a container that lessens the tendency of cohesive solids to adhere, stop, cake or in any way become excessively compacted.

It is a further object of the invention to provide such a vessel which makes it possible to minimize its outlet diameter and at the same time to discharge solids therefrom by gravity at a reasonable discharge rate.

It is still another object of the invention to provide a vessel that minimizes the need for flow aids and promoters.

Other objects of the invention will be in part obvious and in part pointed out hereafter.

SUMMARY OF THE INVENTION

A preferred embodiment of the present invention comprises a container constructed to hold particulate solids, comprising a cone-like wall converging downwardly from at least a top inlet located at the widest diameter portion of the vessel to at least one outlet located at the narrowest diameter portion of the vessel.

In accordance with the present invention, the cone-like downwardly converging wall comprises a smooth inner surface provided with an internal spiral inverted step which, at the point where the step joins the wall, abruptly increases the internal cross-section of the vessel in such a way that the internal cross-sectional area of the container is asymmetrically and continuously enlarged from the upper end to the lower end of the spiral step. In this preferred embodiment the internal, spiral inverted step is a continuous helix extending from the uppermost portion of the vessel to the lowermost portion thereof.

BRIEF DESCRIPTION OF THE DRAWINGS

In this specification and the accompanying drawings, applicant has shown and described a preferred embodiment of his invention and has suggested various alternatives and modifications thereto, but it is to be understood that these are not intended to be exhaustive and that may changes and modifications can be made within the scope of the invention. These suggestions herein are selected and included for purposes of illustration in order that others skilled in the art will more fully understand the invention and the principles thereof and thus will be enabled to modify it and embody it in a variety of forms, each as may be best suited to the conditions of a particular use.

In the accompanying drawings.

DETAILED DESCRIPTION OF A PREFERRED EMBODIMENT

Figure 1:
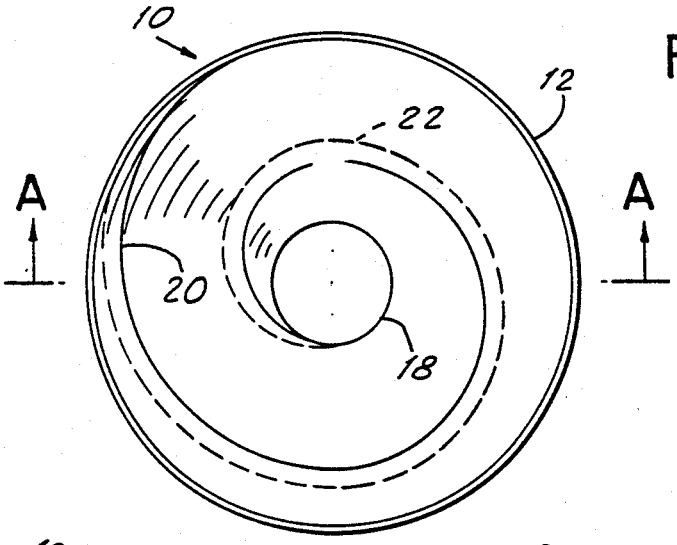
FIG. 1 is a plan view of a container incorporating a preferred embodiment of the invention.

Referring to the drawings, a container or bin 10 constructed according to the invention has a downwardly converging wall 14 from an inlet 12 to an outlet 18. The container wall 14 is so formed that it comprises an internal contiguous surface with an integral internal inverted spirally shaped or helical continuous step 16 which projects outwardly with respect to the bin 10. As better seen in FIG. 3, the step 16 provides an enlargement of the cross-sectional area of the bin as defined by the internal edge 20 and also causes an asymmetry of the internal surface of the bin which tends to destabilize the bridges or domes that would otherwise be formed by the cohesive solid particles.

Figure 3:
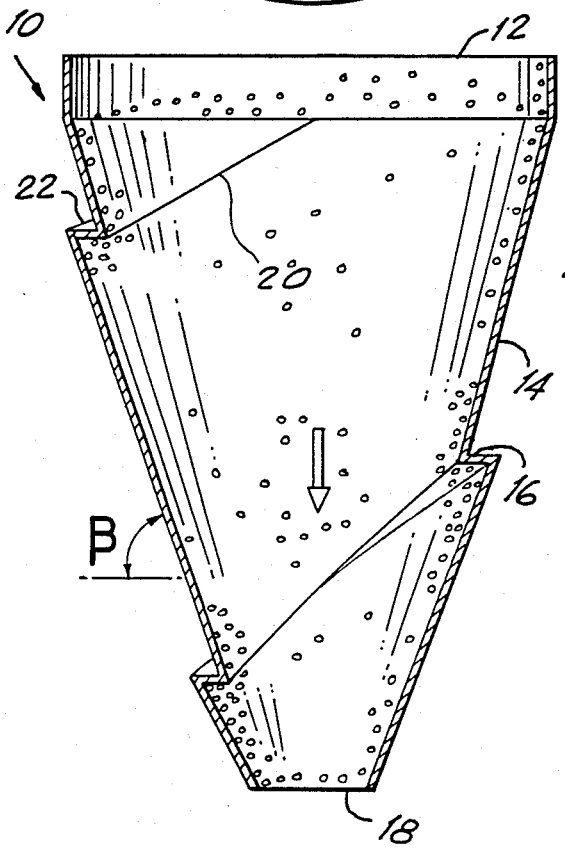
FIG. 3 is a vertical section taken on the line A—A of FIG. 1.
Figure 2:
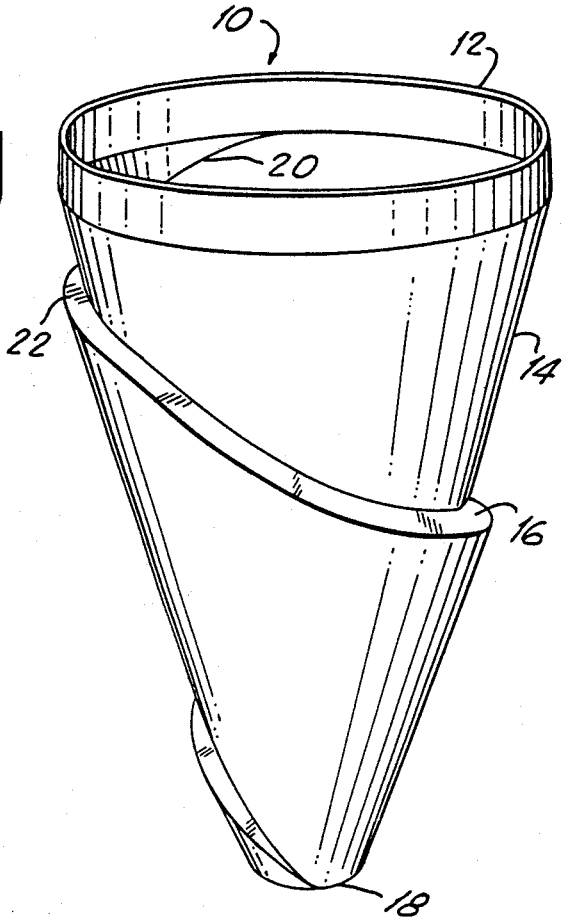
FIG. 2 is an external perspective view of the container of FIG. 1.
Figure 4:
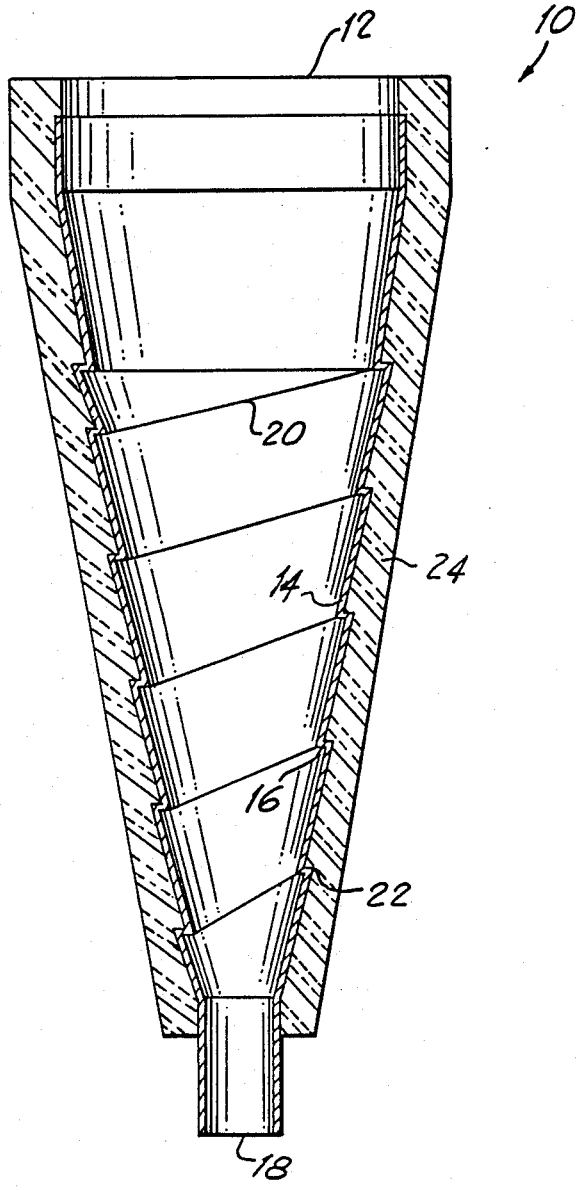
FIG. 4 is a vertical section of an alternative preferred embodiment with insulation such as might be used in a decompression bin for a device for discharging hot sponge iron from a reduction reactor.

This internal inverted step 16 can be formed from top to bottom of the bin, or in some cases only along a portion of the bin, in particular, in those regions where the internal diameter of the bin causes the solid particles to bridge or dome according to their flow characteristics. The tangential angle which the step 16 makes with the horizontal is illustrated in the preferred embodiments to range between about 30° and about 40° in FIG. 3 and between about 15° and about 30° in FIG. 4. Also, the width of the step 16, i.e., the distance between edges 20 and 22, can be varied and adapted to any particular application depending on the particle sizes, the characteristics of the cohesive particles, and the geometry of the bin. In the illustrated preferred embodiment, the width of step 16 is greater than the thickness of the sheet metal wall 14. This is best seen in FIG. 3. As shown in FIG. 4, the container wall 14 in some high temperature uses (such as in the discharge cone of a sponge iron reactor) has an exterior insulation in the form of a wall 24 which is thicker than step 16. The angle of convergence $\beta$ may remain the same (as shown in at least the central part of FIG. 4) or (as shown in FIG. 3) may progressively decrease along the spiral step 16 from a steeper angle of the wall 14 above the step to a less steep angle of the wall 14 below the step for any given point along said step 16. As shown in FIG. 3, the spiral step 16 encircles the converging wall 14 of the conical container 10 about 1½ times (or more, as seen in FIG. 4). It is well known in the art that the convergence angle $\beta$ of the bin 10 (see FIG. 3) is selected according to the characteristics of the solid material being handled, the characteristics of the material of the wall 14 and the type of solids flow desired.

SPECIFIC EXAMPLE

Small scale "modeling" tests have not proven very reliable in solids flow experiments. Furthermore, full-scale tests in pilot plants or commercial installations are generally limited, because of the cost in time and equipment (which does not easily permit extensive testing of many different structural design variations). However, full-scale tests were made of the present invention in conjunction with a pilot plant operation in an attempt to overcome problems encountered in a hot sponge iron discharge mechanism from a moving bed direct reduction reactor. This existing pilot plant was designed for good discharge flow characteristics with cooled sponge iron. There are several practical applications where discharge of hot sponge iron is desirable (such as briquetting or direct feed to electric arc furnaces). However, hot sponge iron with increasing temperature exhibits increasing friction, eventually becoming tacky and even sticky at such higher discharge temperatures. At the extreme upper temperature limits (on the order of 900° to 1000° C., depending upon the type of ore), the hot sponge iron particles sometimes may tend to agglomerate. Since the hot sponge iron particles are thus more cohesive than in the cool state, the smooth flow was impeded and blockages due to bridging resulted. Vibrators and picks are not very desirable, since they treat the symptoms and are costly without effecting a real cure to the problem. Traditional structural design changes such as increasing the steepness of the wall of the conical bin and/or increasing the size of the discharge opening tend to become increasingly undesirable (as they create more problems, including increased cost, than are solved).

In the pilot plant reduction reactor, the moving bed of sponge iron flowing downwardly from the reducing zone flows out from a discharge cone, is metered through a rotary discharge valve into an accumulating "bin" and thence is cycled through a pressure valve into a storage bin functioning as a decompression chamber, which latter has a conical discharge feeding into a further pressure valve (see FIG. 1 of U.S. Pat. No. 3,710,808 showing this structure). The present invention could be applied to the discharge conical portion of any one of these structures (i.e. the discharge of the reactor itself, of the accumulating bin, or of the decompression bin). The main stoppage problems were encountered in the decompression bin; therefore, this was focused upon for the initial tests for simple comparison. The accumulating bin had fewer problems because it is much smaller (and thus has less of a pressure head). As shown in U.S. Pat. No. 3,710,808, it has a conical discharge, but in the pilot plant it is merely a large straight pipe. Since it accumulates sponge iron only for a minute or so every thirty minutes (i.e. during discharge of the decompression bin), it does not require a very large capacity. The reactor's discharge cone has fewer problems, because the bed is in a continuous mass flow which tends to discourage bridging that develops more easily in a static bed. The angle $\beta$ of the decompression bin in the pilot plant is 80°. In the temperature range of 400° C. to 750° C. (and above) stoppages due to bridging of the sponge iron particles were encountered with increasing frequency in direct ratio to the increasing temperature. Such stoppages for some types of ore may became common above 700° C. For contrast, a demonstration bin was constructed equivalent to the decompression bin of the pilot plant, but was modified to incorporate the spiral step feature of the present invention (and was made out of carbon steel rather than stainless steel). Tests were then run with sponge iron particles equivalent to those which had been giving trouble in the pilot plan operation with the following results:

EXPERIMENTAL DATA

| Outlet Temp. | Kg. of Material | Time Stored | Discharge Time | Kind of Material |
|---|---|---|---|---|
| 600° C. | 340 | 30 Min. | 20 Sec. | 100% Pellets: Size Distr. |
| 600° C. | 340 | 30 Min. | 20 Sec. | ⅛" to ½" |
| 760° C. | 430 | 30 Min. | 37 Sec. | |
| 780° C. | 430 | 30 Min. | 80 Sec. | 90% Pellets plus 10% Fines. |
| 820° C. | 430 | 30 Min. | 30 Sec. | 100% Pellets Size Distr:. ⅛" to ½" |

As can be seen from the foregoing, bridging stoppages were completely eliminated over the temperature range of 600° C. to 820° C. even though the net effective conical angle was the same in both bins.

It will be appreciated that the angle $\beta$ in the spiral stepped bin may be closer to 75° or even flatter for any individual portion of the spiral wall, but because of the spiral steps, the effective slope will be the same 80° as in the straight-walled conical discharge of the original pilot plant. This effective slope can vary by at least ±5°. In FIG. 4 is illustrated an embodiment of the invention such as would be used in place of the conventional straight-walled conical discharge of a sponge iron reactor. The circular bottom of the inlet 12 and the circular top of the outlet 18 define a virtual (i.e. intangible) conical surface whose surface coincides with the upper converging walls of the bin 10 above the beginning of the step 16. Thus the intangible conical surface and the bin 10 at this upper portion have the same convergence angle $\beta$. The lower portion of the bin 10 has the inverted spiral step 16 which defines an inner edge 20. As shown in the FIG. 4, only the edge 20 lies within the intangible conical surface in such lower portion of the bin 10; while the wall 14 at the level of the spiral step 16 (i.e. generally between successive turns of the spiral step 16) lies outside the volume defined by the intangible conical surface (and thus has a flatter convergence angle $\beta$ relative to that of the upper portion of the bin 10). It will also be understood that the spirally stepped bin was not physically installed in the pilot plant, but was otherwise subjected to essentially identical conditions (excepting only filling of the demonstration bin under ambient pressure rather than the typical 3 to 5 atm. reduction reaction pressure, both bins being discharged under the same ambient pressure).

The foregoing example confirmed the effectiveness of this new concept in overcoming the problems in handling more cohesive particles, and in this case obviating the need of significantly increasing the angle of the discharge cone (which would have necessitated a large increase in the size and cost of the bin). It will be appreciated that this inventive concept would also facilitate in similar applications a foreshortening of the bin design, which because of the flatter angle $\beta$ would result in an increase in the bin capacity.

From the foregoing description it should be apparent that structures incorporating the present invention are capable of achieving the objectives and providing the advantages outlined above. As will be understood from the stated objectives, this invention in its broader aspects is applicable to overcoming solids flow problems through a bin for many kinds of solid particles (whether particularly cohesive or not). By providing an enlargement of the cross-sectional area of the bin, the solids compaction is minimized; thus the solids continue flowing through the container under almost any circumstances, allowing configurations with narrower outlet diameters to be used.

It is of course to be understood that the foregoing description is intended to be illustrative only and that numerous changes can be made within the scope of the invention and as will be apparent to those skilled in the art, e.g., the bin can be open or alternatively, sealed with respect to the atmospheric air in cases where contact with the air is dangerous or alters the quality of the material being handled. Also, the bin can have a rectangular or oval cross-section instead of a generally conical shape, and the number of turns of the spirally shaped or helical continuous step can be varied and extend to all or only a portion of the container.

What is claimed is:

1. A gravity flow container for particulate solids comprising a downwardly converging container wall extending from at least an inlet to at least a discharge outlet, said wall having an internal contiguous surface with an integral internal inverted spiral step continuously extending from an upper portion to a lower portion of the wall along at least a part of said wall to provide an asymmetrical and continuous enlargement of the cross-sectional area of said container immediately below said step, the width of said step being greater than the thickness of said container wall.

2. A container according to claim 1 having only one discharge outlet.

3. A container according to claim 2 wherein said converging wall is a substantially conical wall.

4. A container according to claim 3 wherein said internal inverted step is helical.

5. A container according to claim 3 wherein said internal inverted step extends from the top to the bottom of said wall.

6. A container according to claim 3 wherein said internal inverted step extends through the range of area of said wall where cohesive particulate solids tend to form a bridging or similar stoppage.

7. A container according to claim 2, wherein the internal surface of said container wall has a convergence angle $\beta$ which decreases progressively from said upper portion to said lower portion of said wall.

8. A container according to claim 7, wherein said converging wall is substantially conical.

9. A container according to claim 7, wherein the convergence angle $\beta$ of any given portion of the container wall can have a value in the range between about 80 degrees to about 75 degrees.

10. A container according to claim 2, wherein said spiral step encircles the converging wall of said container at least one and a half times.

11. A container according to claim 1 wherein said internal inverted step extends from the top to the bottom of said wall.

12. A gravity flow container for particulate solids comprising a downwardly converging generally conical container wall extending from a circular inlet to a smaller circular discharge outlet, said inlet and outlet defining an intangible conical surface therebetween, said wall having an internal surface with an integral internal inverted spiral step formed therein continuously extending from an upper portion to a lower portion of the wall along at least a part of said wall to provide an asymmetrical approximately conical shape, said step having an internal edge and an external edge, said internal edge defining a spiral which lies essentially on said intangible conical surface, the wall of said container at least above or below said spiral step also lying essentially on said intangible conical surface thus having a convergence angle $\beta$ which is substantially the same as a convergence angle $\beta$ of said intangible conical surface, the wall of said container at the external edge of said spiral step lying outside of said intangible conical surface thus having a convergence angle $\beta$ less than the convergence angle $\beta$ of said intangible conical surface, wherein the angles $\beta$ are the respective angles which said wall and said intangible conical surface make with a plane perpendicular to the central axis of said intangible conical surface.

13. A container according to claim 12, wherein the angle $\beta$ of the intangible conical surface is about 80 degrees.

14. A container according to claim 13, wherein said internal inverted step extends from the top to the bottom of said wall.

15. A container according to claim 12, wherein said spiral step makes a tangential angle relative to the horizontal of between about 15 and about 40 degrees.

16. A container according to claim 12, wherein said spiral step encircles the converging wall of said container at least one and a half times.

17. A container according to claim 12, wherein the spiral step as it continuously extends from said upper portion to said lower portion of said container wall defines container wall portions, each container wall portion having a separate distinct convergence angle wherein the convergence angles $\beta$ of the container wall portions range between about 80 degrees to about 75 degrees from the inlet to the outlet.

* * * * *